United States Patent [19]

Zaglio et al.

[11] 4,218,897

[45] Aug. 26, 1980

[54] DEVICE FOR INDICATING A CONDITION OF NEARLY EXHAUSTED YARN RESERVE ON A BOBBIN TO STOP AUTOMATICALLY A HOSIERY KNITTING MACHINE

[75] Inventors: Sergio Zaglio; Luigi Marchetti, both of Castiglione Delle Stiviere, Italy

[73] Assignee: Internazionale Brevetti S.r.l., Italy

[21] Appl. No.: 5,981

[22] Filed: Jan. 23, 1979

[30] Foreign Application Priority Data

Oct. 25, 1978 [IT] Italy ..... 29090 A/78

[51] Int. Cl.[2] ..... D04B 35/12

[52] U.S. Cl. ..... 66/163; 242/37 R

[58] Field of Search ..... 242/37 R, 57; 19/0.26; 28/187; 66/163; 112/277

[56] References Cited

U.S. PATENT DOCUMENTS

| | | | |
|---|---|---|---|
| 43,294 | 6/1864 | Dalton | 242/37 R X |
| 46,186 | 1/1865 | Hart | 242/37 R UX |
| 291,965 | 1/1884 | Walsh | 242/37 R X |
| 655,616 | 8/1900 | Foster | 242/37 R |
| 2,910,555 | 10/1959 | Tunstall | 242/57 X |
| 2,954,940 | 10/1960 | Herrmann | 242/57 X |
| 3,312,084 | 4/1967 | Sharp et al. | 66/163 |
| 3,411,730 | 11/1968 | Kelley | 242/57 X |
| 3,850,380 | 11/1974 | Kranefeld | 242/57 X |

*Primary Examiner*—Wm. Carter Reynolds

*Attorney, Agent, or Firm*—Shlesinger, Fitzsimmons & Shlesinger

[57] ABSTRACT

For a textile machine fed by yarn bobbins, such as a hosiery knitting machine and like apparatus, a device is provided for detecting the condition in which the yarn is nearly finished in any bobbin and for stopping the machine automatically prior to having to suffer from damage to the article being knitted.

A system of fixed and movable contacts associated to each section of the bobbin is provided, the movable contacts being responsive to the presence and the pressure of the yarn so that when the yarn pressure on the bobbin stud begins to be released, the movable contact closes an alarm and stopping circuit.

1 Claim, 4 Drawing Figures

DEVICE FOR INDICATING A CONDITION OF NEARLY EXHAUSTED YARN RESERVE ON A BOBBIN TO STOP AUTOMATICALLY A HOSIERY KNITTING MACHINE

This invention relates to a device which can be used with circular hosiery knitting machines and like machines for indicating a nearly exhausted yarn condition on a bobbin so as to cause the automatic stoppage of such a machine.

It is known that a problem which is common to all the textile machinery which is fed by yarn bobbins is that of preventing that the yarn wound on a bobbin may finish while the machine is still running. Such an event would originate, actually, an unavoidable serious damage to the article being manufactured.

The solution of such a problem becomes especially serious in the case of speedy machines such as the circular knitting machines for hosiery and like machines, in which a considerable promptness of action is required, which the present devices for detection and stopping fall far short of achieving.

According to the invention, the problem is solved in an outstandingly satisfactory manner by a device which is characterized in that it comprises, for each bobbin, a movable electric contact associated to the bobbin so as to be resiliently biassed in a position which is radially projecting from the bobbin but is normally held in position radially retracted from the yarn wound on the bobbin, said movable electric contact being an integral of a two-position switch inserted in an electric control circuit for the machine so as to originate the automatic stoppage when said movable contact is in said radially projecting position as a result of the condition of exhausting of the yarn on the bobbin being about to be attained.

It is apparent that the device according to the invention enables the machine to work entirely normally until the yarn tightly wound on each bobbin maintains its movable contact in the retracted position, whereas it enter promptly action to stop the machine as soon as the yarn, being nearly at the finish point, and thus slackening its winding tension, allows the movable contact to be shifted to the projecting position and thus to switch the relative switch off. Inasmuch as the device is capable of feeling the exhaustion of the yarn reserve prior to that it actually takes place, the device of this invention lends itself, apparently, very well also for speedy machines, to which all the time is left which is required to stop before the complete exhaustion of the yarn reserve.

The features of the present invention will become more clearly apparent from the ensuing detailed description of a preferred practical embodiment of same, as illustrated by way of example in the accompanying drawings, wherein.

Figure 2:
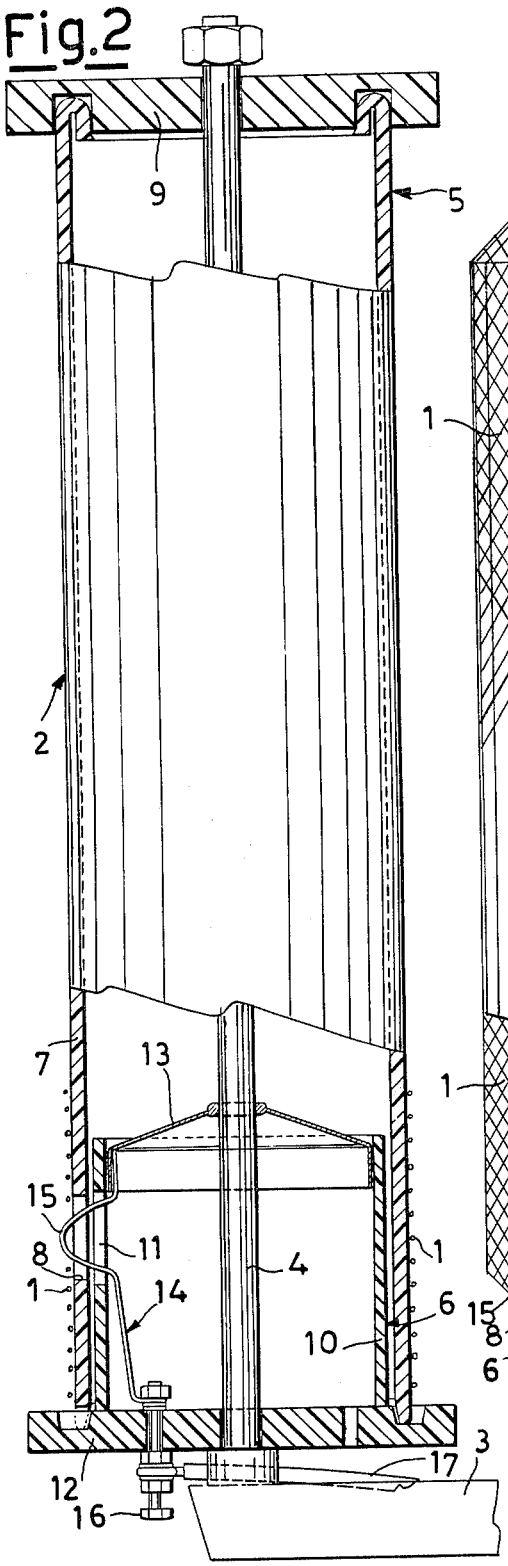
FIGS. 1 and 2 are elevational views, partly in cross-section, of a bobbin for circular hosiery knitting machines and like machines, equipped with a detection and stoppage device according to the invention in its two respective positions of operation.
Figure 1:
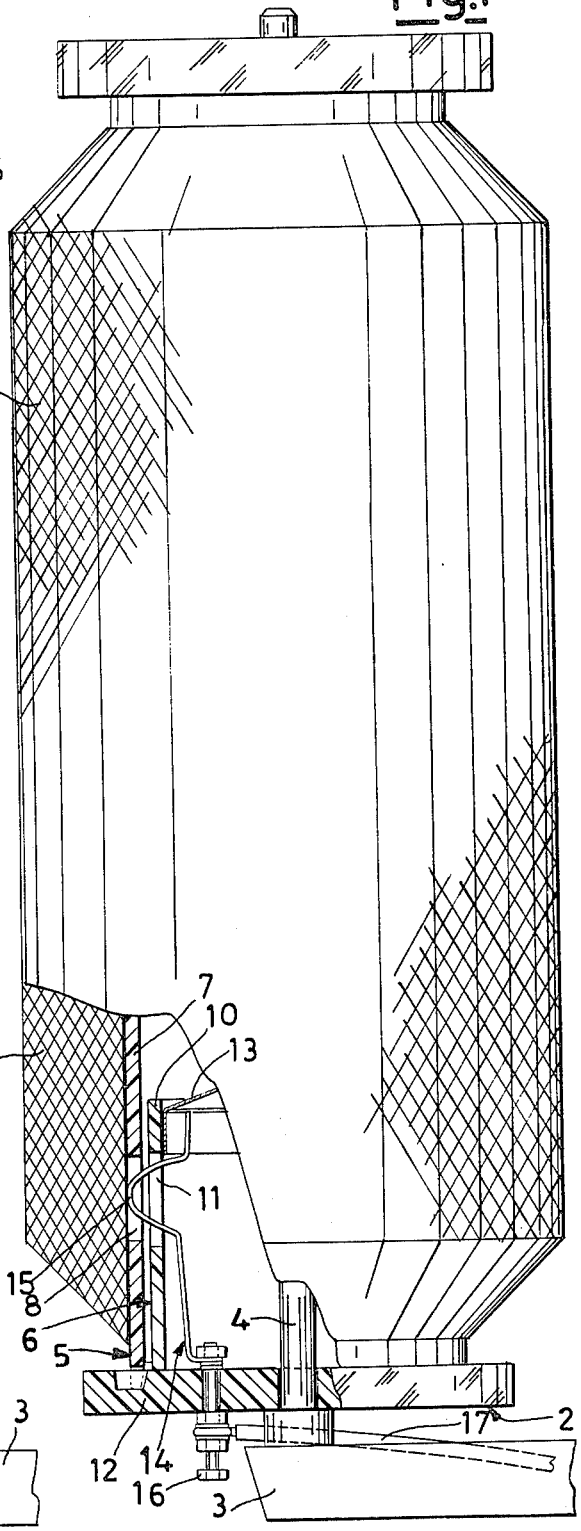

FIGS. 1 and 2 show, respectively, a bobbin 2 for hosiery knitting machine or any like machine, in the position in which the bobbin is full of yarn 1, and in the position in which its yarn is nearly exhausted. The bobbin is mounted on a metallic rack 3 (a part of the machine) about a centering stud 4 made of an electrically conductive metal.

The bobbin 2 is composed by two sections, 5 and 6, which are releasably slipped into one another, the first section having an elongate cylindrical wall 7 with a rectangular slit 8 and a closure lid 9, the second section having a shorter cylindrical sidewall 10 also having a slit 11 in register with 8, a closure lid 12 and, on the side away of the lid, a nearly cylindrical cap 13 in electric and mechanical contact with the stud 4. In the interior of the bobbin section 6 there is housed an electric contact 14 which is movable and has a humpback portion 15 which is resiliently biassed to project radially from the bobbin body through the aligned slits 8 and 11 (FIG. 2) but which is normally held in the retracted position by the yarn 1 wound around the bobbin (FIG. 1). The movable contact 14 is supported by and electrically connected with a fixed terminal 16 to which is connected an electric feeding lead 17 and, according to the position it takes, it opens and closes a two-position switch composed by the movable contact 14 as such and the metal cap 13 (connected to the ground via the stud 4 and the supporting member 3).

Figure 4:
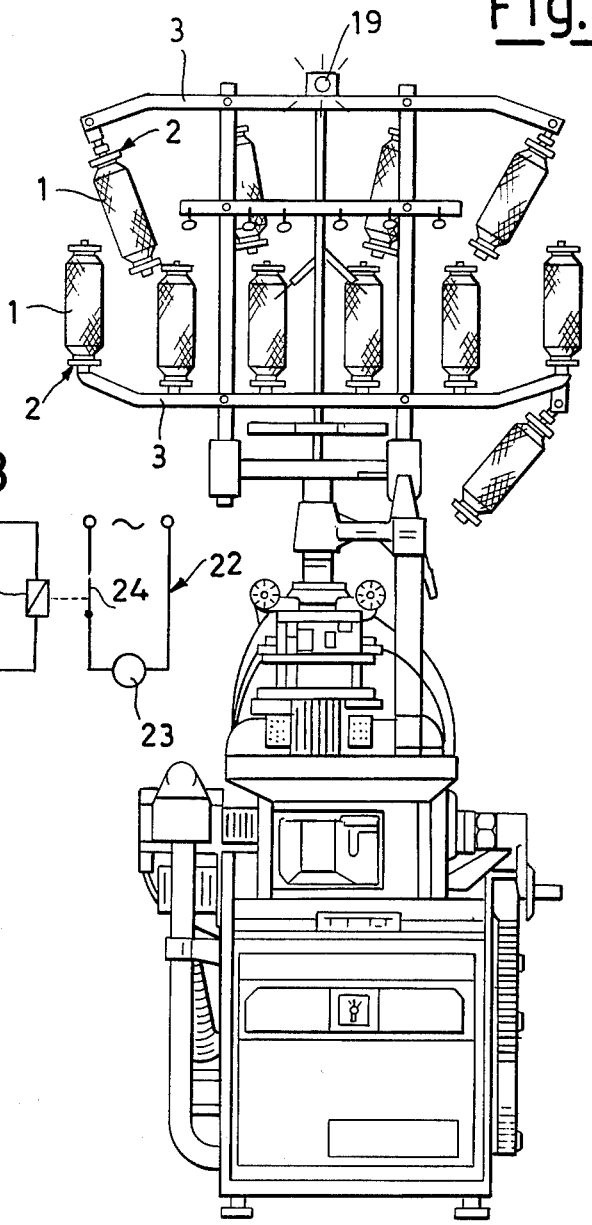
FIG. 4 shows diagrammatically the layout of a circular hosiery knitting machine employing the bobbins with the detection and stopping device shown in FIGS. 1 and 2.
Figure 3:
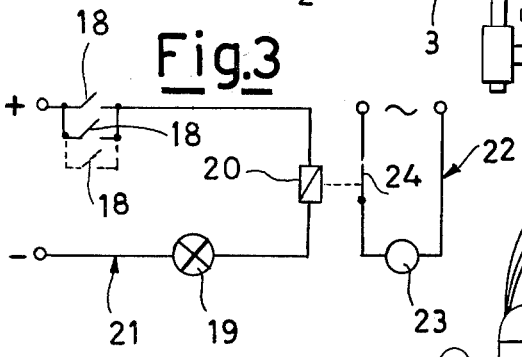
FIG. 3 shows the simplified diagram of the electric control circuit for the machine of which the switch is an integral part.

With this and other bobbins mounted on a circular hosiery knitting machine such as for example that of FIG. 4, the several switches (18) defined by the electric contact 14 and the fixed contact 13 are connected in parallel, as shown in FIG. 3, in an electric checkup circuitry which comprises a DC section 21 including also a relay coil 20 and a pilot lamp 19 placed in a visible location on the machine frame (FIG. 4), and an AC section 22 entrusted with the power feed to the machine motor 23 and including a movable contact 24 controlled by the relay coil 20.

As a result, the operation of the detection and stoppage mechanism shown in the drawings is as follows.

Until such time as a sufficient amount of yarn is wound about each bobbin 2, the yarn itself holds the movable electric contacts 14 in the retracted position as in FIG. 1 and thus the switches 18 are open, the relay 20 is not energized, the contact 24 is closed and the motor 23 of the machine is in the normal feed condition. As the yarn approaches its exhaustion on a bobbin as in FIG. 2, the quantity and the tension of the yarn are no longer adequate to prevent the humpback portion 15 of the movable contact 14 from emerging through the aligned slits 8 and 11 until making the electric connection between the movable contact 14 and the fixed contact 13.

The relative electric switch 18 is thus closed, the lamp 19 is lit and the relay 20 is energized to open the movable contact 24 and thus to cause the stoppage of the motor 23 and thus of the entire machine.

We claim:

1. A device for detecting a condition of forthcoming exhaustion of yarn that is wound on the cylindrical sidewall of a bobbin, and for causing the automatic stoppage of an associated circular hosiery knitting machine or the like, comprising, for each bobbin, a movable electric contact associated with the bobbin, and disposed to be pushed resiliently to a radially projecting position from the sidewall of the bobbin but normally held in a radially retracted position in the bobbin by the yarn wound around the bobbin, said movable electric contact being an integral part of a two-position switch inserted in an electric checkup circuit for the machine so as to cause the automatic stoppage of same when said movable contact is in said radially projecting position as a result of the approaching to a condition of exhaustion of the yarn around the bobbin, said electric movable contact being housed within the bobbin and being resiliently biased to have a portion thereof projecting radially out of the bobbin through a slit formed through said sidewall thereof, said movable electric contact cooperating with a fixed electric contact on the bobbin composed of a metal cap roughly cylindrical and through which a bobbin-centering cylindrical stud passes in electric contact with said cap, said bobbin being made in two releasably connected sections inserted into one another, the external section forming part of said cylindrical sidewall on which the yarn is wound, the inner section housing said movable electric contact and being provided with a cylindrical sidewall of reduced extension closed by said metal cap, and having formed therethrough a slit which is aligned with the first-named slit and through which slits said portion of the movable contact is urged to project.

* * * * *